US005295903A

United States Patent [19]

Bolton et al.

[11] Patent Number: 5,295,903

[45] Date of Patent: Mar. 22, 1994

[54] SIDE CURTAIN ASSEMBLY FOR AIR CONDITIONING UNIT

[75] Inventors: Theodore S. Bolton, Liverpool; John H. Michaels, Baldwinsville, both of N.Y.

[73] Assignee: Carrier Corporation, Syracuse, N.Y.

[21] Appl. No.: 14,391

[22] Filed: Feb. 5, 1993

[51] Int. Cl.[5] ..... F25D 23/12

[52] U.S. Cl. ..... 454/203; 454/201

[58] Field of Search ..... 454/203, 201, 204, 202; 62/262

[56] References Cited

U.S. PATENT DOCUMENTS

| | | | |
|---|---|---|---|
| 2,799,062 | 7/1957 | Callan | 454/201 |
| 2,830,336 | 4/1958 | Moore et al. | 20/69 |
| 3,134,319 | 5/1964 | Marsteller | 98/94 |
| 3,481,264 | 12/1969 | Ulich | 98/94 |
| 3,811,370 | 5/1974 | Boston, Jr. et al. | 98/94 |
| 3,861,283 | 1/1975 | Shaner | 454/203 |
| 4,607,500 | 8/1986 | Bolton et al. | 62/262 |
| 5,193,355 | 3/1993 | Matsumi | 62/262 |

FOREIGN PATENT DOCUMENTS

| | | | |
|---|---|---|---|
| 102036 | 6/1983 | Japan | 62/262 |

*Primary Examiner*—Henry A. Bennet
*Assistant Examiner*—William C. Doerrler

[57] ABSTRACT

An extendable side curtain assembly for use in association with a window air conditioning unit that can be snap locked to the cabinet without the use of tools or the like.

8 Claims, 5 Drawing Sheets

SIDE CURTAIN ASSEMBLY FOR AIR CONDITIONING UNIT

BACKGROUND OF THE INVENTION

This invention relates to a room air conditioning unit, and in particular to a snap on curtain assembly for use in a room air conditioning unit.

It is common practice to secure the curtain panels of a window air conditioning unit to the enclosure which houses the working parts of the unit using permanent fasteners. This type of fastening has been found to be difficult to accomplish during manufacture or replacing panels in the field. An example of air conditioning units equipped with such permanent fasteners is described in U.S. Pat. No. 3,811,370 to Boston et al. In addition, because the fasteners used to join the curtain frame to the unit are extremely difficult to reach, special tools must sometimes be devised to facilitate installation and removal of the frame.

OBJECTS AND SUMMARY OF THE INVENTION

It is therefore an object of the present invention to improve window air conditioning units.

It is another object of the present invention to provide a snap on side curtain assembly for a window air conditioning unit that can be easily installed and removed from the unit.

It is a further object of the present invention to provide an adjustable side curtain assembly for a window air conditioning unit that can be mounted upon the unit without the use of special tools.

Another object of the present invention is to provide for rapid installation and removal of the side curtains from a window air conditioning unit.

These and other objects of the present invention are attained by means of a window air conditioner having side curtains mounted thereon in adjustable frames. Each curtain is secured at one end to a vertically disposed channel shaped locking member that forms part of the frame. The channel is made of a resilient material and is adapted to receive through its open end face a second locking member secured to the side wall of the enclosure housing the air conditioner. The enclosure locking member includes a vertically disposed bar having retaining ears spaced along one of its side walls and locking tabs spaced along the opposing side wall. The locking tabs are arranged to resiliently snap under locking rib mounted on the frame locking member as the enclosure locking member passes into the channel shaped enclosure member thus locking the curtain assembly to the enclosure.

BRIEF DESCRIPTION OF THE DRAWINGS

For a better understanding of these and other objects of the present invention, reference will be made to the following detailed description of the invention which is to be read in association with the accompanying drawings, wherein.

DETAILED DESCRIPTION OF A PREFERRED EMBODIMENT

Figure 1:
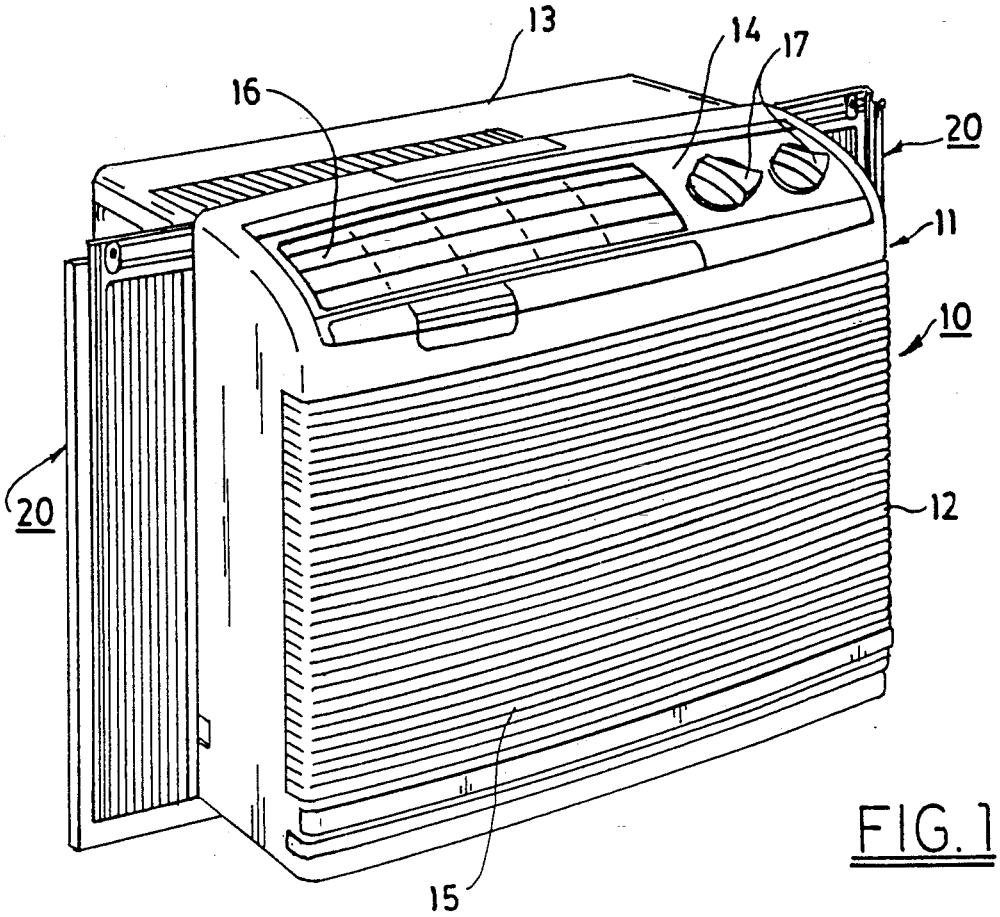
FIG. 1 is a perspective view of a window air conditioning unit embodying the teachings of the present invention.
Figure 2:
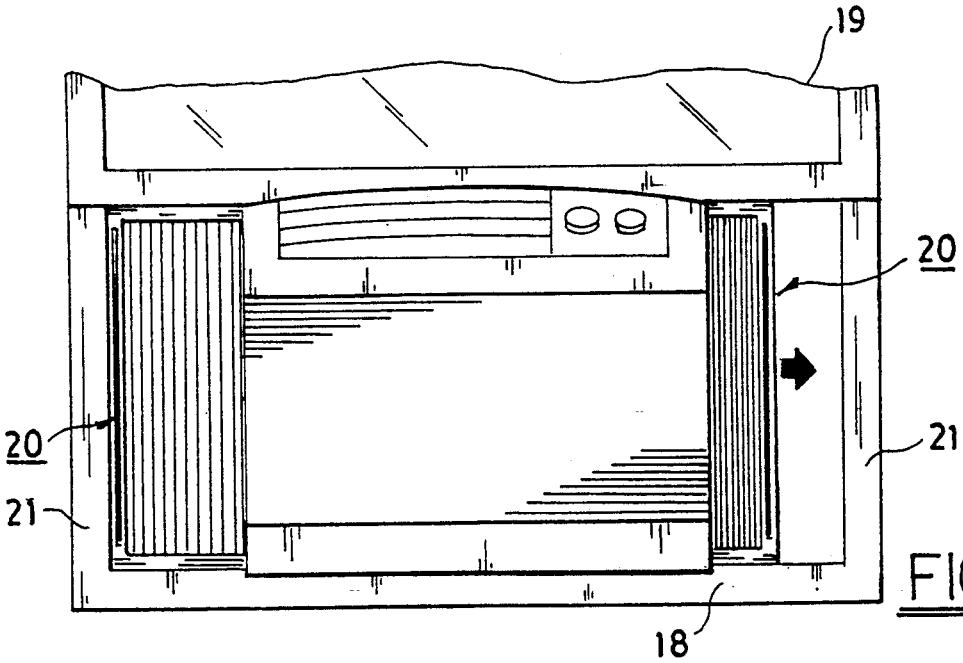
FIG. 2 is a front elevation showing the unit of FIG. 1 mounted within a window frame.

Turning initially to FIGS. 1 and 2, there is shown a window air conditioning unit, generally referenced 10 of the type typically used to cool a room. As is well known, the type of unit is designed to fit upon a sill in the lower part of a window frame with the window being closed against the top of the unit. Side curtain assemblies are generally attached to the unit and arranged to expand laterally to close the window area between the unit and the window sides thereby preventing conditioned air from being lost to the surrounding ambient. As noted above, the curtain assemblies are typically secured to the unit by threaded fasteners or the like thus making installation and removal of the assemblies difficult.

The air conditioning unit 10 includes an outer enclosure 11 made up of a front cover 12, a rear cover 13 and a top deck 14. Air to be conditioned is drawn into the unit through the louver front face 15 of the unit and, after being cooled, is discharged through the openings 16 in the top deck. Control knobs 17—17 are also provided in the top deck. A pair of adjustable side curtain assemblies 20—20 embodying the teachings of the present invention are slidably mounted in the enclosure.

As illustrated in FIG. 2, the front cover of the unit is adapted to rest on the sill 18 of a window frame and the window 19 is brought down to rest upon the rear cover just behind the slightly higher front cover to hold the unit in place. The adjustable side curtain assemblies can then be extended laterally against the adjacent window frames 21—21 to close the window opening.

Figure 3:
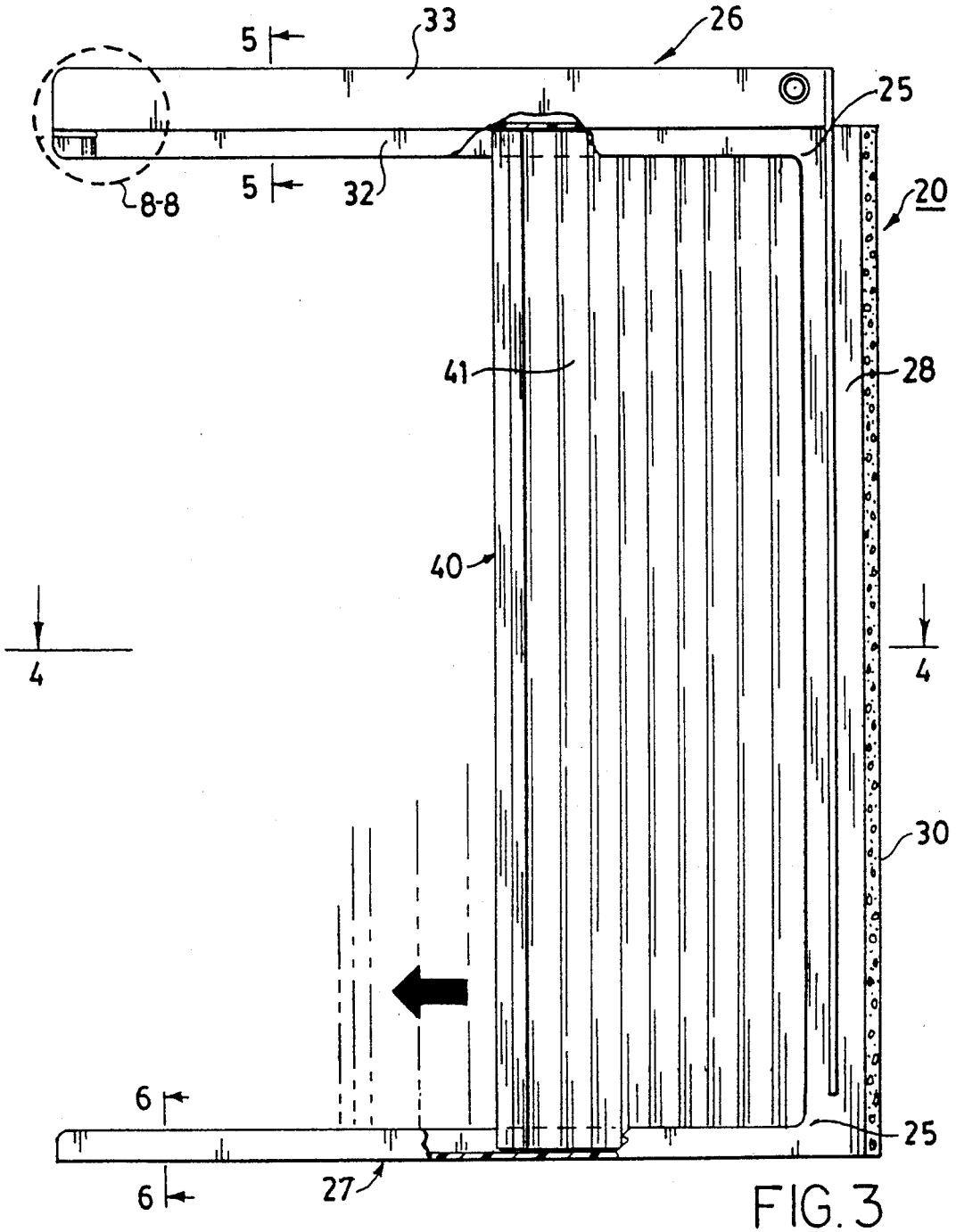
FIG. 3 is an enlarged front elevation showing one of the side curtain assemblies utilized in the unit of FIG. 1.
Figure 4:
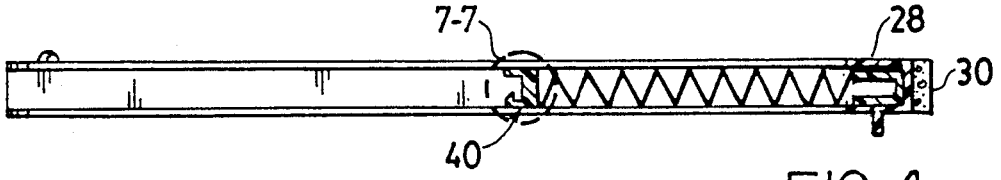
FIG. 4 is a sectional view taken along lines 4—4 in FIG. 3.
Figure 5:
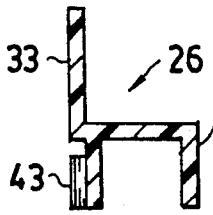
FIG. 5 is a section taken along line 5—5 in FIG. 3.

Each side curtain assembly is of similar construction and therefore the structure and construction of the assemblies will be described primarily with reference to the right hand assembly as seen in FIG. 1. As best viewed in FIGS. 3 and 4, each side curtain assembly 20 includes a frame 25 that includes an upper slide bar 26 and a lower slide bar 27 that are joined by an end bar 28. The three bars are preferably integrally molded from any suitable plastic material. The end bar is arranged to close against the window side and is furnished with a foam sealing strip 30 that can be placed in conforming contact against the sash.

Figure 6:
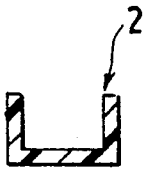
FIG. 6 is a section taken along lines 6—6 in FIG. 3.
Figure 9:
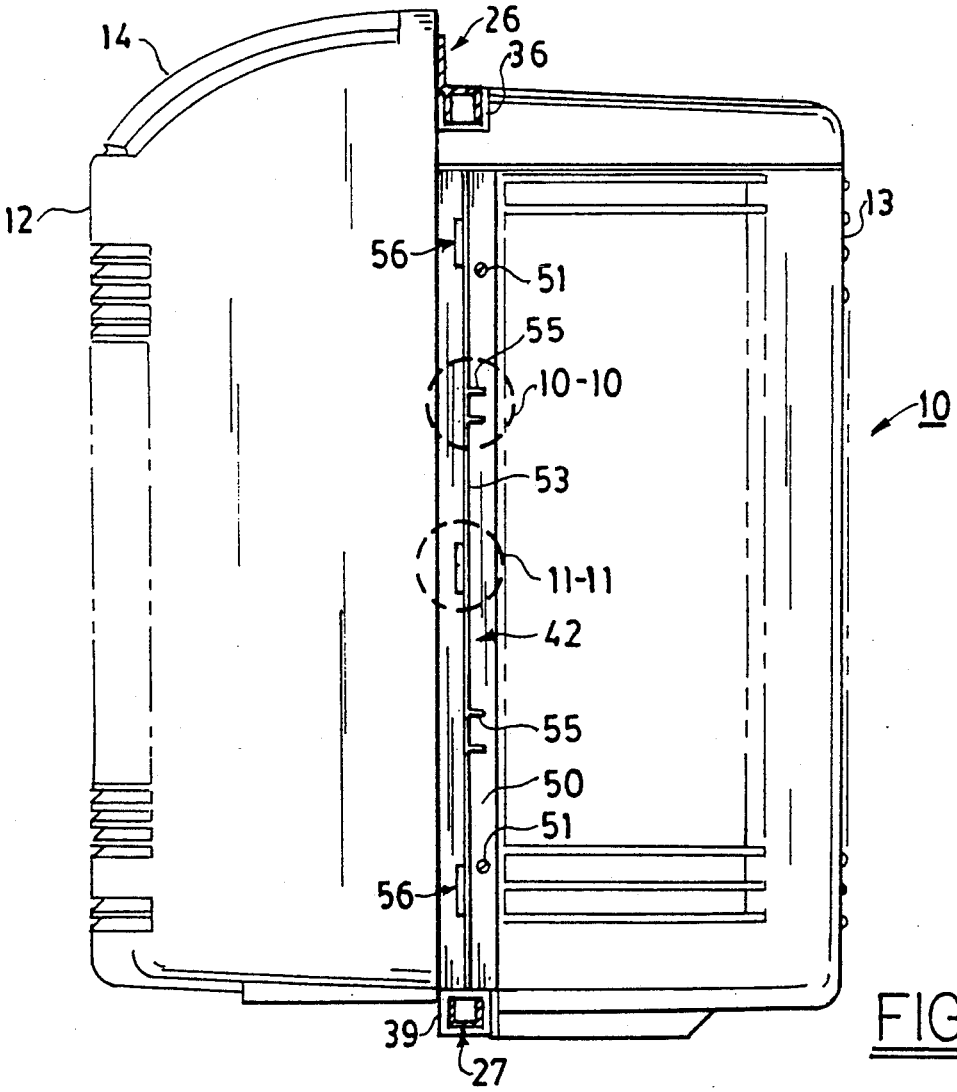
FIG. 9 is a side elevation in partial section of the present air conditioning unit showing the construction of the enclosure locking member which is adapted to snap into a frame member mounted on a side curtain assembly.

The upper slide bar 26 includes a channel shaped body 32 having a raised arm 33 that rests against the lower part of the window when the unit is installed in a window frame. The lower slide bar 27 is a channel shaped piece as shown in FIG. 6. The upper slide bar is adapted to ride in a channel shaped upper slide retainer 36 carried in the top part of the unit (FIG. 9). The lower slide bar is adapted to ride in a rectangular shaped lower slide retainer 39 carried in the bottom of the unit. A vertically disposed frame locking member 40 is slidably contained in the channels of the two opposed slide bars. A pleated curtain 41 is also contained in the opposed channels with the side edges of the curtain securely attached to vertical member 40 and the end bar 28 of the side curtain frame 25.

Figure 8:
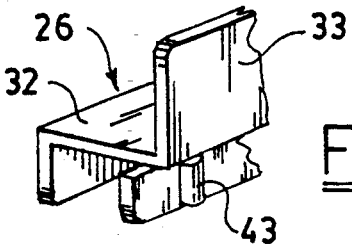
FIG. 8 is an enlarged detail in perspective of the top rail of the curtain assembly frame taken at 8—8 in FIG. 3.
Figure 15:
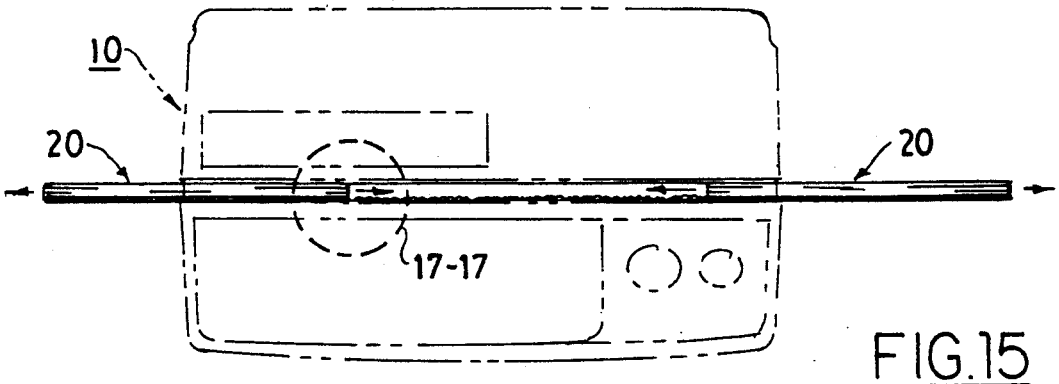
FIG. 15 is a top view of the present unit showing the side curtain assemblies mounted thereon.
Figure 16:
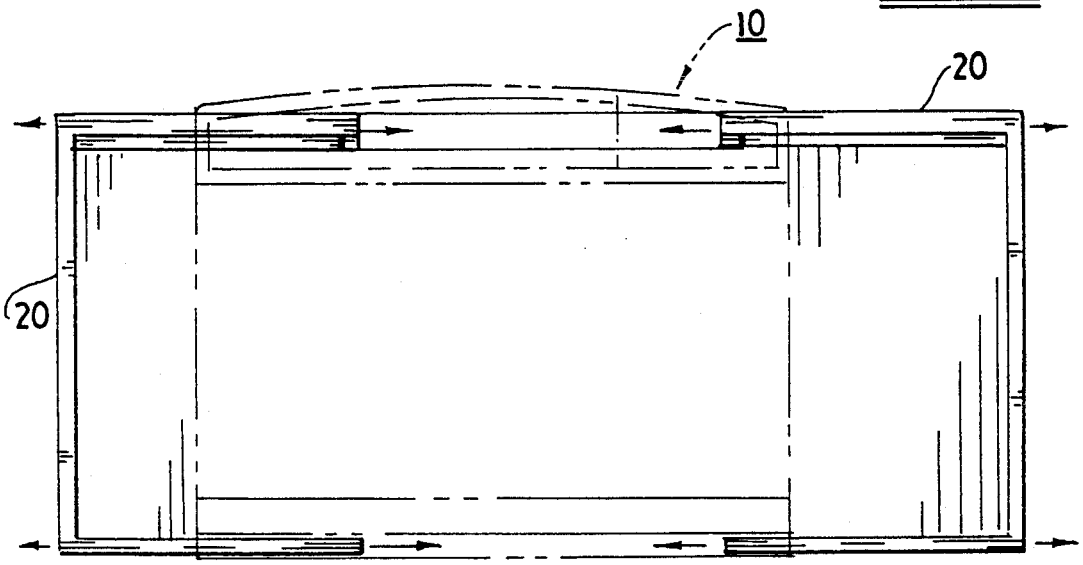
FIG. 16 is a front elevation showing the side curtain assemblies mounted upon the unit.
Figure 17:
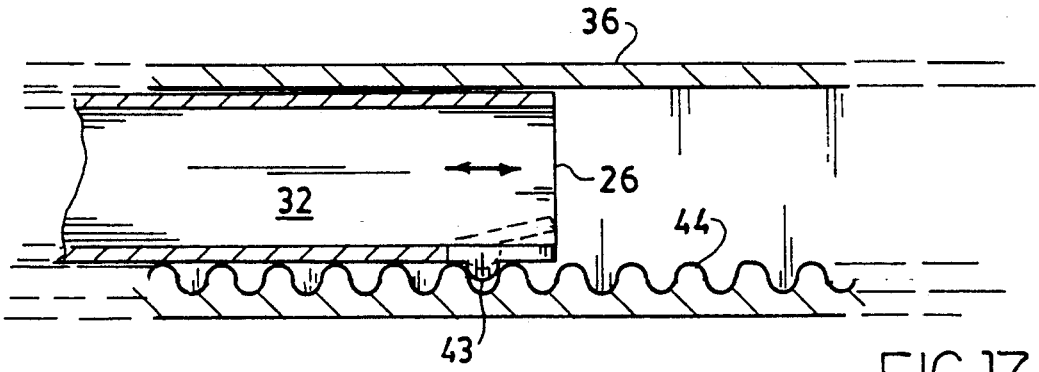
FIG. 17 is a partial enlarged top view at 17—17 in FIG. 15 further illustrating the adjusting mechanism for the side curtain assemblies.

As will be explained in greater detail below, the frame locking member 40, in assembly, is connected to a second enclosure locking member 42 mounted on the side wall of the unit enclosure. The pleated curtain will thus be expanded or contracted as the frame 25 is slidably positioned within the cabinet. The distal end of the top slide bar 26 is provided with a lug 43 (FIG. 8) that is adapted to ride in a grooved portion 44 of the upper retainer 36 (FIG. 17). The lug and the grooved section function as a detente mechanism which permits the side curtain frame to be releasably indexed into a number of positions as illustrated in FIGS. 15 and 16.

Figure 11:
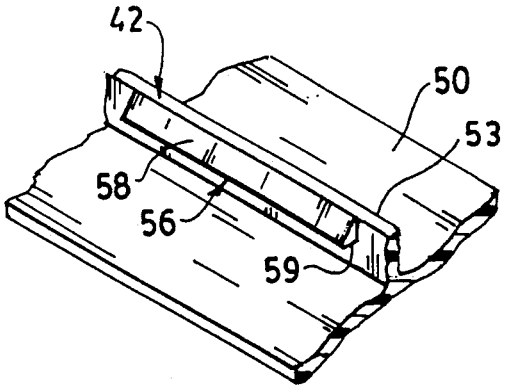
FIG. 11 is also a partial perspective view of the enclosure locking member illustrating the locking tabs mounted thereon.
Figure 10:
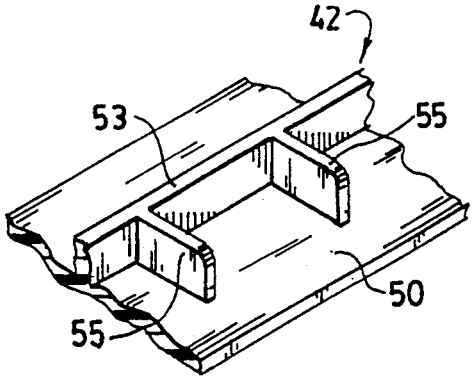
FIG. 10 is a partial perspective view of the enclosure locking member illustrated in FIG. 9 showing the retaining ears mounted thereon.

With further reference to FIGS. 10–14 the enclosure locking member 42 includes a base 50 that is secured to the unit enclosure 11 by threaded fasteners 51—51 or the like (FIG. 9). A vertical bar 53 is centrally mounted upon the base and extends the full length thereof. Retaining ears 55—55 are spaced apart in pairs along one side of the bar. Locking tabs 56—56 are spaced along the opposite side of the bar with the tabs being positioned approximately midway between the retaining ear pair. Each locking tab is mounted along the top edge of the bar as illustrated in FIG. 11. The tabs are triangular shaped elements containing a bevelled top surface 58 and a flat bottom surface 59 that is perpendicular to the bar.

Figure 7:
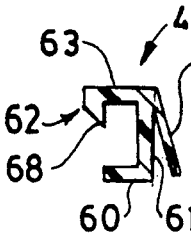
FIG. 7 is an enlarged detail of a resilient channel member making up part of the curtain assembly frame taken at 7—7 in FIG. 4.

As best illustrated in FIG. 7, the vertically disposed frame locking member 40 includes a channel shaped body having a pair of legs 60 and 63 connected to a base 61. A locking rib 62 is located at the top edge of one of the legs and extends laterally into the open entrance region between the channel legs. The outer surface 68 of the locking rib is also bevelled at about the same angle as the top surface of the locking tabs mounted on enclosure locking member 42.

In assembly, when the upper and lower slide bars of the side curtain frame are mounted in the upper and lower enclosure slide retainers and the enclosure locking member 42 is aligned with the vertical frame locking member 40. The frame locking member is formed of a resilient plastic material that is capable of being deformed sufficiently to allow the locking tabs on the enclosure locking member to pass beneath the locking rib on the frame locking member. The distance measured over the retaining ears and the locking tabs is slightly less than the inside distance between the opposed legs of the frame locking member so that the enclosure locking member will fit snugly inside the frame locking member when the two are snapped together.

Figure 12:
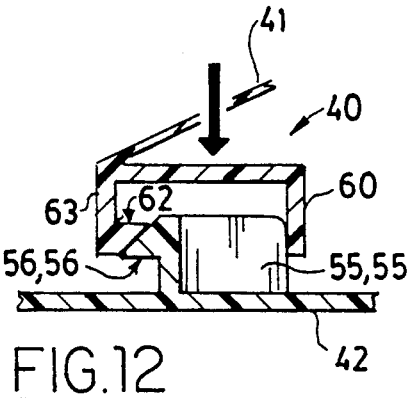
FIG. 12 is a side elevation showing the enclosure locking member entering the channel of the frame member of the side curtain assembly.
Figure 13:
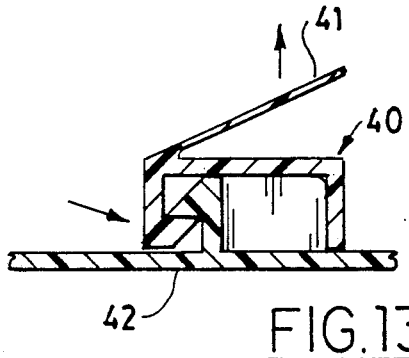
FIG. 13 is also a side elevation showing the enclosure locking member locked in place within the frame locking member.
Figure 14:
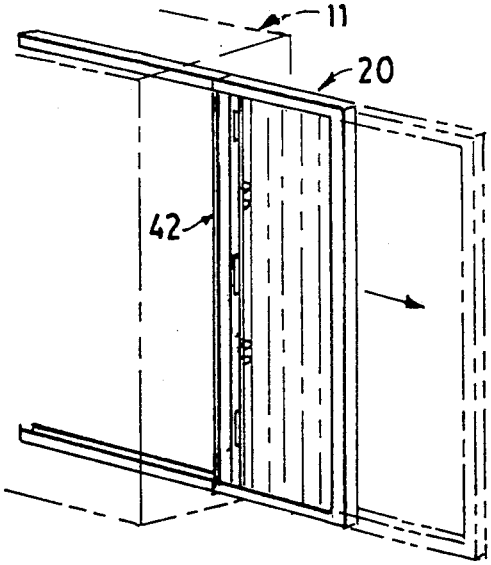
FIG. 14 is a perspective view illustrating the operation of the side curtain assembly.

The members are snapped together as illustrated in FIGS. 12 and 13. Initially, the slide bars are slidably positioned in the cooperating enclosure retainers and the frame locking member is brought into contact with the enclosure locking member as shown in FIG. 12. Leg 60 of the frame locking member passes partially over the retaining ears 55 and the bevelled surfaces of the locking tabs come in contact with the bevelled surface of the locking rib. The locking tabs are offset vertically from the retaining ear pairs to permit the frame locking member to bend or flex sufficiently in the vertical plane so that the locking tabs can be snapped under the locking rib. Once the tabs have passed under the rib, the flexed frame locking member will resume its initial non deformed configuration thus locking the two members together in assembly as shown in FIG. 13.

To disconnect the side curtain assembly for the enclosure the frame locking member is simply flexed or bent between the retaining ear pairs sufficiently to free the locking tabs from beneath the locking rib whereby the frame locking member can be moved back from the enclosure locking member. The connecting and disconnecting of the side panel assembles can be accomplished using only hand pressure so that the side curtain assembles can be quickly and easily removed during manufacturing or in the field for servicing.

While this invention has been explained with reference to the structure disclosed herein, it is not confined to the details set forth and this application is intended to cover any modifications and changes as may come within the scope of the following claims:

What is claimed is:

1. An extendable side curtain assembly for use in a room air conditioner comprising:

an enclosure housing a window air conditioning unit, said enclosure further including a first vertically disposed locking member secured to a side wall thereof;

an adjustable frame containing an expandable curtain, said frame being slidably mounted in said enclosure adjacent to said side wall;

said frame further containing a second vertically disposed locking member joined to one end of said curtain and being movably mounted in said adjustable frame;

one of said locking members being a resilient U-shaped open-sided channel having a pair of opposed legs and a base, said open side of said channel facing the other locking member and containing a locking rib means mounted upon one leg of the channel that passes laterally into the entrance region of said channel opening; and said other locking member being receivable within said channel opening of said one locking member, and containing a locking tab means for resiliently passing under the locking rib means to join together the members in locking engagement.

2. The extendable side curtain assembly of claim 1 wherein the resilient U-shaped open-sided channel is formed on said second vertically disposed locking member and said locking tab means is formed on said first vertically disposed locking member being mounted on the side wall of said unit enclosure.

3. The extendable side curtain assembly of claim 2 wherein said locking rib extends longitudinally along the entire length of said one locking member and said other locking member includes a center bar capable of passing into said channel opening, said bar having spaced apart retaining ears extending laterally to one side of the bar for engaging with one leg of the channel and spaced apart locking tabs extending laterally from the other side of said bar that are arranged to resiliently pass under the locking rib mounted on the opposite leg of said channel to secure the curtain assembly to the enclosure of the unit.

4. The extendable side locking curtain assembly of claim 3 wherein the top surface of the rib facing the other locking member is inclined toward the base of the channel and the top surfaces of the locking tabs are similarly inclined inwardly toward the enclosure whereby the locking tabs are directed under the locking rib when the two members are brought together in sliding contact.

5. The extendable side curtain assembly of claim 3 wherein the curtain is pleated and one end of said curtain is affixed to the base of said frame locking member channel.

6. The extendable side curtain assembly of claim 3 wherein said channel is formed of a resilient plastic and said locking tabs are located midway between the retaining ears whereby the channel can bend about the ears to sufficiently permit the locking tabs to pass beneath the locking rib.

7. The extendable side curtain of claim 6 wherein said other locking member includes a base that is secured to the air conditioning unit enclosure.

8. Apparatus for locking an extendable side curtain assembly to an enclosure of an air conditioning unit that includes a first vertical locking member that includes a bar extending along one side wall of the enclosure, spaced apart retaining ear pairs extending horizontally from one side of said bar, spaced apart locking tabs extending horizontally from the other side of said bar, said tabs being located about midway between said retaining ear pairs, a second channel shaped locking member being about equal in length to that of said first locking member and having a pair of parallel legs spaced apart a distance about equal to the distance over the retaining ears and the locking tabs on said first locking member whereby the first locking member is receivable within the second locking member, locking rib means mounted on one leg of the channel of said second locking member that extends inwardly into the entrance of said channel opening to engage each of the locking tabs on said bar when the first locking member is placed within the channel of the second locking member to secure the channel to the side wall of the enclosure, and an extendable curtain secured to the channel.

* * * * *